US005663513A

United States Patent [19]

Sugiyama et al.

[11] Patent Number: 5,663,513

[45] Date of Patent: Sep. 2, 1997

[54] KEYBOARD MUSICAL INSTRUMENT PERFORMABLE WITHOUT NOISE IN SILENT MODE

[75] Inventors: Nobuo Sugiyama; Haruki Uehara, both of Shizuoka, Japan

[73] Assignee: Yamaha Corporation, Japan

[21] Appl. No.: 631,799

[22] Filed: Apr. 10, 1996

[30] Foreign Application Priority Data

Apr. 14, 1995 [JP] Japan ..... 7-089858

[51] Int. Cl.[6] ..... G10F 1/02; G10H 1/053; G10H 1/46

[52] U.S. Cl. ..... 84/21; 84/3; 84/171; 84/658; 84/719

[58] Field of Search ..... 84/2, 3, 20–22, 84/170–172, 615, 626, 633, 658, 665, 621, 719, 720

[56] References Cited

U.S. PATENT DOCUMENTS 4,756,223 7/1988 Murakami ..... 84/21

*Primary Examiner*—Stanley J. Witkowski
*Attorney, Agent, or Firm*—Graham & James LLP

[57] ABSTRACT

A keyboard musical instrument is fabricated on the basis of an acoustic piano, and a hammer stopper and solenoid-operated actuators are provided for hammer assemblies and black and white keys; and a controller instructs the solenoid-operated actuators to move the black and white key at different velocities depending upon the position of the hammer stopper, and causes the acoustic piano to give little offense to the ear at a blocking position of the hammer stopper.

9 Claims, 7 Drawing Sheets

KEYBOARD MUSICAL INSTRUMENT PERFORMABLE WITHOUT NOISE IN SILENT MODE

FIELD OF THE INVENTION

This invention relates to a keyboard musical instrument and, more particularly, to a keyboard musical instrument having solenoid-operated actuators for automatically playing a keyboard and a hammer stopper for fingering without acoustic sounds.

DESCRIPTION OF THE RELATED ART

An automatic player piano is an acoustic piano equipped with solenoid-operated actuators under the keyboard, and a built-in controller reads out a series of event data codes or music data codes from a data storage medium such as a floppy disk. The built-in controller selectively supplies driving current to the solenoid-operated actuators, and the solenoid-operated actuators energized by the built-in controller pull down the associated keys as if a player fingers the keyboard. As a result, the acoustic piano generates the acoustic sounds, and the built-in controller plays the acoustic piano instead of the player.

FIG. 1 illustrates the control sequence executed by the built-in controller repeated upon every data fetch. The built-in controller firstly checks the music data code to see whether the music data code defines a motion of a key incorporated in the keyboard or not as by step SP1.

If the answer at step SP1 is given-negative, the music data code defines the motion of another manipulative element such as a damper/muffler/soft pedal, and the built-in controller proceeds to step SP2. The built-in controller actuates the manipulative element as instructed by the music data code at step SP2. Upon completion of the task instructed by the music data code, the built-in controller returns to a main routine (not shown).

On the other hand, if the answer at step SP1 is given affirmative, the music data code defines the motion of a key forming a part of the keyboard, and the built-in controller proceeds to step SP3. The built-in controller converts a piece of velocity information indicative of a key/hammer velocity into a key velocity data with reference to an internal table. The key velocity data represents the amount of the driving current supplied to the solenoid-operated actuator associated with the key.

Upon determination of the amount of the driving current, the built-in controller proceeds to step SP4, and supplies the driving current to the solenoid-operated actuator. The solenoid-operated actuator generates the force proportional to the amount of driving current, and moves the associated key. The key actuates an associated key action mechanism, and the key action mechanism rotates a hammer assembly toward a set of strings. When the hammer assembly strikes the set of strings, the set of strings vibrates, and generates an acoustic sound.

After the supply of the driving current to the solenoid-operated actuator, the built-in controller returns to the main routine.

Thus, the built-in controller repeats the loop consisting of steps SP 1 to SP4 for every music data code, and the solenoid-operated actuators move the associated keys and the associated pedals as if the acoustic piano is played by a pianist.

A keyboard musical instrument equipped with a hammer stopper is also known. The keyboard musical instrument is also fabricated on the basis of an acoustic piano, and a hammer stopper is provided between the hammer shanks and the sets of strings. The hammer stopper is changed between a free position and a blocking position. While the hammer stopper is staying at the free position, the hammer assemblies are allowed to strike the sets of strings. On the other hand, when the hammer stopper is changed to the blocking position, the hammer assemblies rebound on the hammer stopper before an impact on the strings, and a built-in electronic sound generating system generates electronic sounds instead of the acoustic sounds. If the player hears the electric sounds through a headphone, he can practice the fingering on the keyboard without a disturbance of neighbors.

If the hammer stopper is provided between the hammer assemblies and the sets of strings incorporated in the prior art automatic player piano, the solenoid-operated actuators play the acoustic piano without an acoustic sound. For example, while a pianist is playing the acoustic piano in the silent mode, the built-in controller records the key/hammer motions, and stores a series of music data codes in the data storage medium. Thereafter, if the built-in controller reproduces the key/hammer motions without an acoustic sound, the pianist can confirm the performance through the electronic sounds.

However, a problem is encountered in that noises disturbs the reproduction. The noises are generated at the rebound on the hammer stopper and the actuations of the solenoid-operated actuators. In fact, the silence manifests the friction sound between the plunger and the coil bobbin and the impact sound between the key and the back/front rails, and the noises are loud under a large key velocity.

SUMMARY OF THE INVENTION

It is therefore an important object of the present invention to provide a keyboard musical instrument which decreases the noises in a playback through electronic sounds.

The present inventors contemplated the problem inherent in the prior art keyboard musical instrument, and noticed that actuators only moved keys in synchronism with electronic sounds. Therefore, if the keys started to sank slightly before a tone generation of an electronic sound, it is acceptable to proportionally decrease the key velocities. The present inventor concluded that the key was slow down in the playback through the electronic sounds to the extent that the mechanical noises did not give little offensive to the ear.

To accomplish the object, the present invention proposes to move keys in a different velocity range from the key velocity in a playback through acoustic sounds.

In accordance with the present invention, there is provided a keyboard musical instrument comprising: an acoustic keyboard musical instrument including a keyboard having a plurality of keys respectively assigned notes of a scale and selectively moved by a player, a plurality of vibrative string means for generating acoustic sounds having the notes, respectively, a plurality of hammer assemblies each driven for a free rotation so as to strike one of the plurality of vibrative string means, and a plurality of key action mechanisms respectively connected between the plurality of keys and the plurality of hammer assemblies so as to respectively rotate the plurality of hammer assemblies, each of the plurality of key action mechanisms causing one of the plurality of hammer assemblies to escape therefrom before an initiation of the free rotation; a hammer stopper provided for the plurality of hammer assemblies, and changed between a free position and a blocking position, the hammer stopper in the free position allowing the plurality of hammer assemblies to strike the plurality of vibrative string means, the hammer stopper in the blocking position causing each of the plurality of hammer assemblies to rebound thereon between the initiation of the free rotation and a strike against one of the plurality of vibrative string means; a plurality of actuators respectively provided for the plurality of keys, and respectively responsive to instructions for moving the plurality of keys instead of the player at respective key velocities, each of the key velocities being varied by changing a magnitude of one of the instructions; a source of music data codes each containing a piece of impact data information indicative of the loudness of one of the acoustic sounds; and an instruction generating means supplied with the music data codes from the source for regulating the magnitudes of the instructions, the magnitudes of the instructions being changed in a first range when the hammer stopper is in the free position, the magnitude of the instructions being changed in a second range different from the first range so as to restrict the key velocity when the hammer stopper is in the blocking position.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENT

Figure 1:
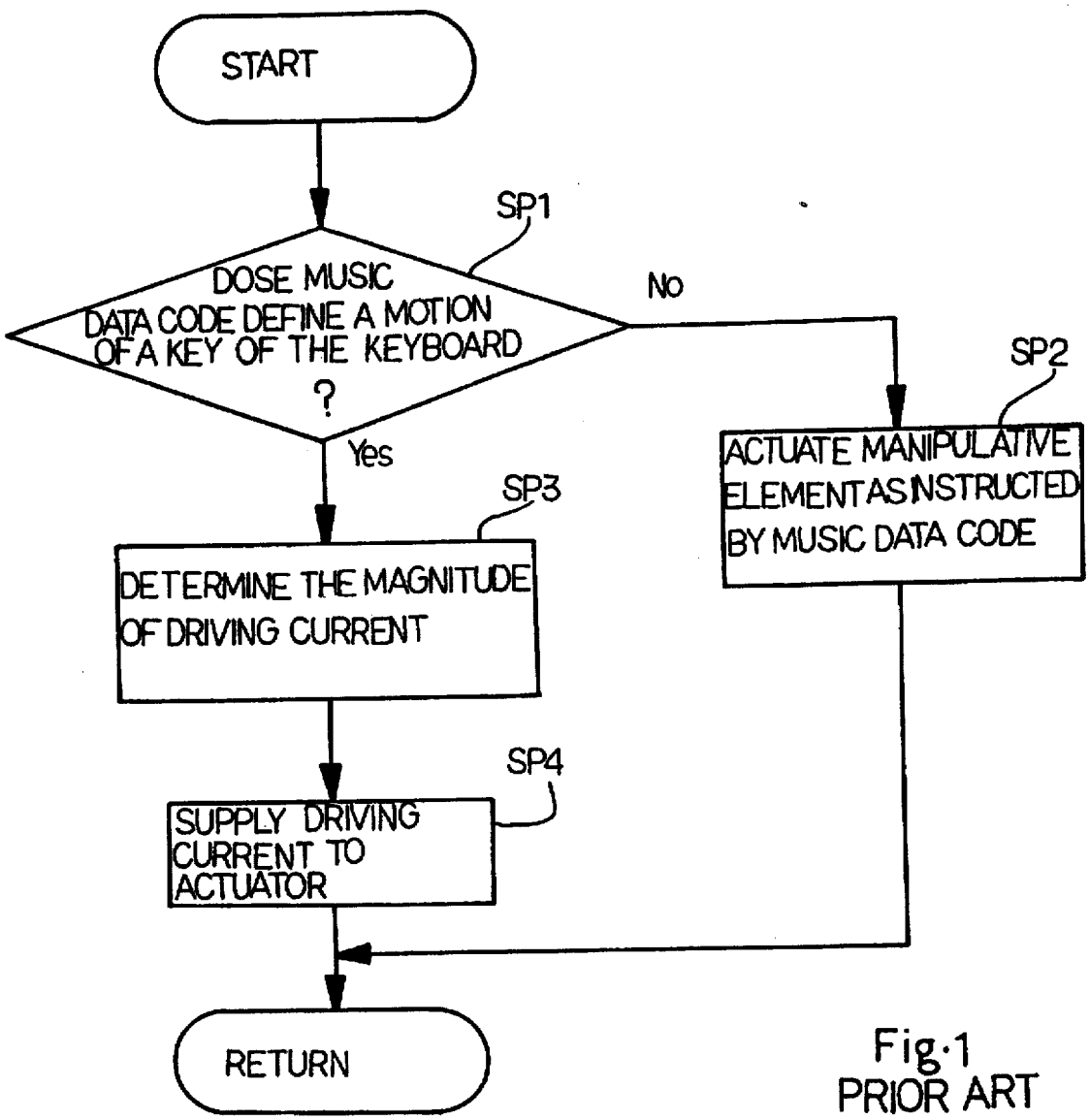
Fig.1 PRIOR ART
FIG. 1 is a flow chart showing the controlling sequence of the prior art automatic player piano.
Figure 2:
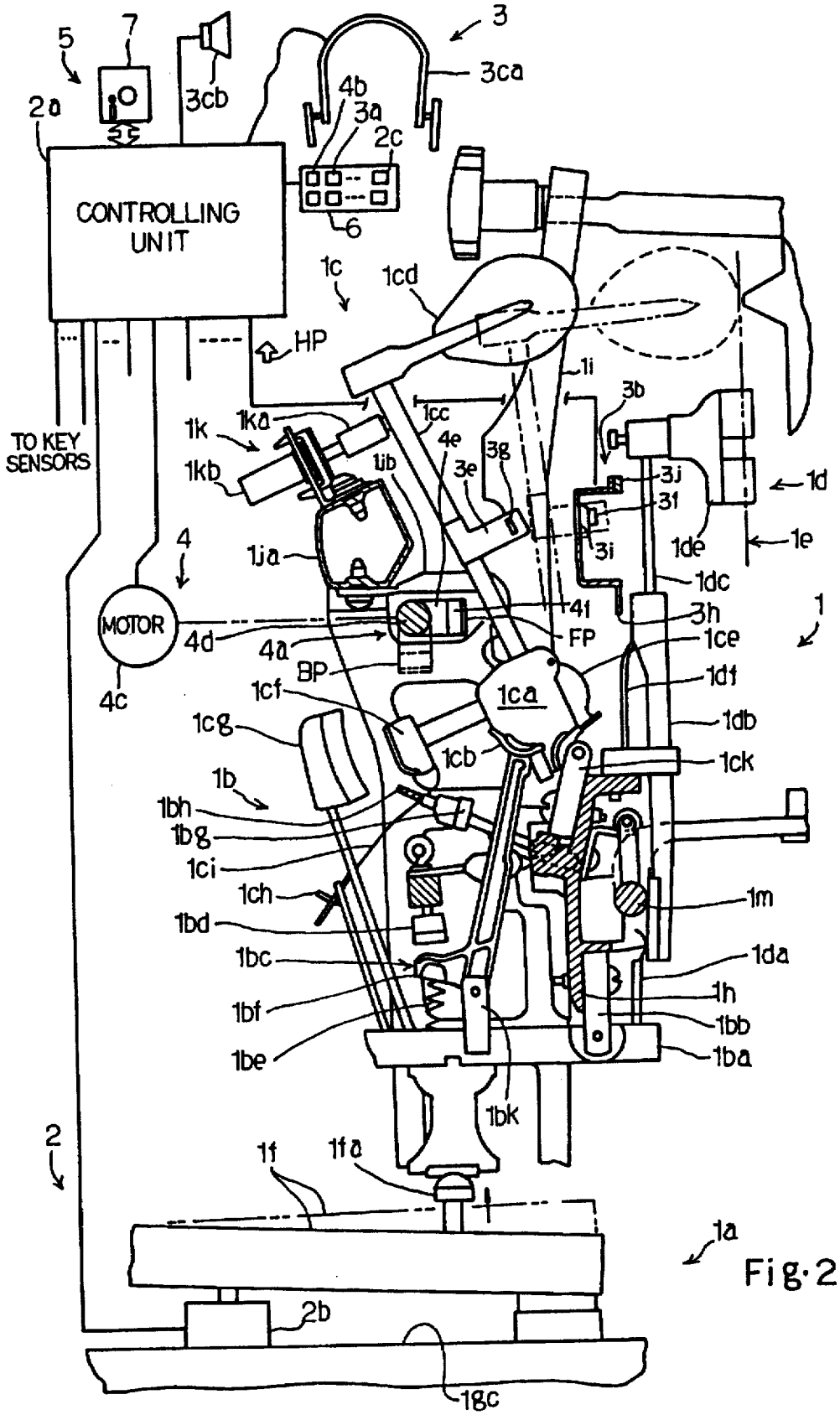
FIG. 2 is a side view showing the structure of a keyboard musical instrument according to the present invention.

Referring first to FIG. 2 of the drawings, a keyboard musical instrument embodying the present invention largely comprises an acoustic piano 1, an automatic playing system 2, an electronic sound generating system 3, a silent system 4 and a recording system 5, and selectively enters into a standard playing mode, an automatic playing mode, a silent mode and a recording mode. As described hereinbelow, the automatic playing mode has a acoustic sound sub-mode and an electronic sound sub-mode.

A pianist performs music through acoustic sounds in the standard mode like a standard upright piano. While the keyboard musical instrument is staying in the acoustic sound sub-mode, the automatic playing system 2 sequentially reads out a series of music data codes representative of a performance from a data storage medium, and generates the acoustic sounds without the fingering. If the pianist selects the silent mode, the silent system 4 does not allow the acoustic piano 1 to generate the acoustic sounds in response to the fingering, and the electronic sound generating system 3 generates electronic sounds instead of the acoustic sounds. In the electronic sound sub-mode, although the automatic playing system 2 actuates the acoustic piano 1 as similar to the acoustic sound sub-mode, the silent system 4 intercepts the generation of the acoustic sounds, and the electronic sound generating system 3 generates the electronic sounds instead of the acoustic sounds. Finally, the recording mode is carried out with and without acoustic sounds, i.e., in the standard playing mode or in the silent mode, and the recording system 5 stores a series of music data code representative of the performance in a data storage medium such as a floppy disk.

Figure 3:
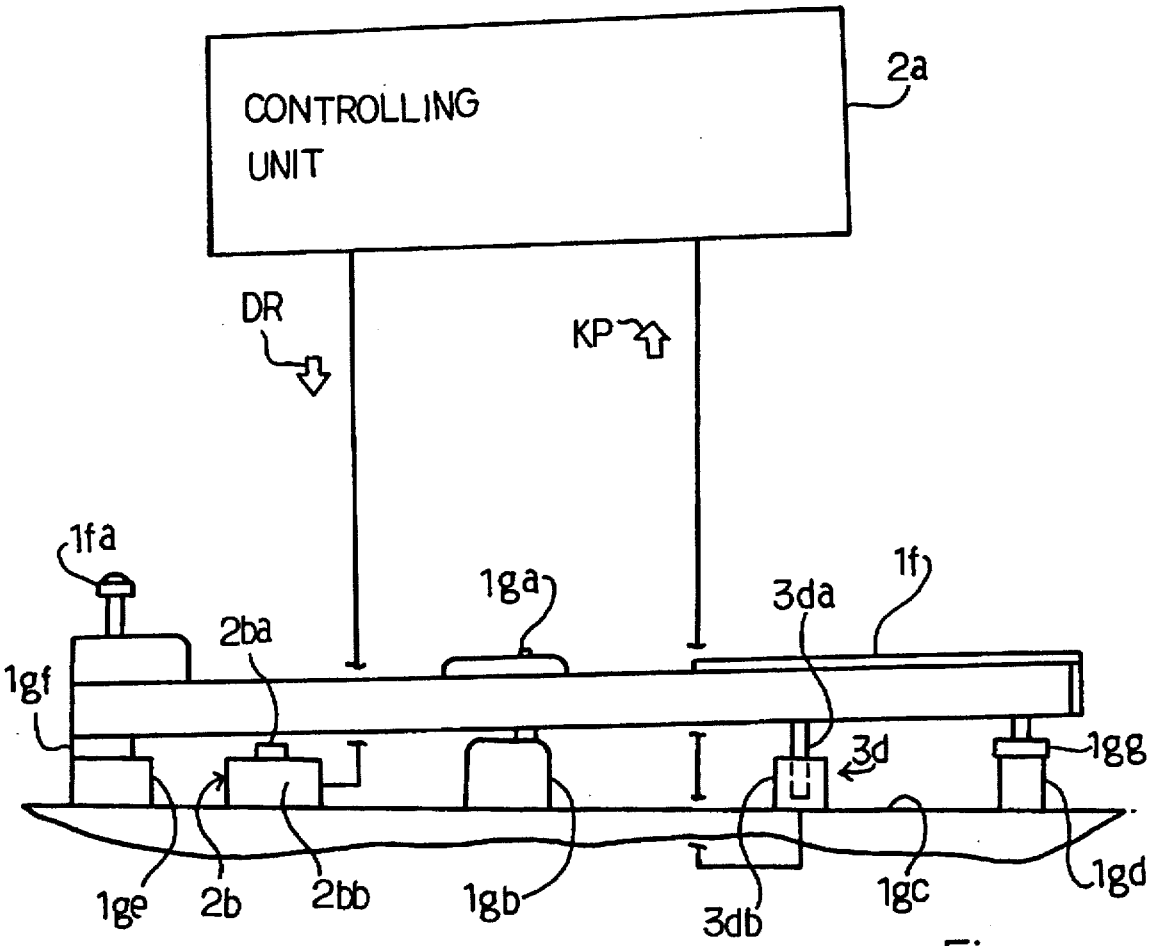
FIG. 3 is a side view showing one of the black and white keys incorporated in the keyboard musical instrument.

Description is hereinbelow made on the acoustic piano 1, the automatic playing system 2, the electronic sound generating system 3, the silent system 4 and the recording system 5 with concurrent reference to FIG. 3 of the drawings. In the following description, word "front" means a position closer to a pianist sitting in front of the acoustic piano than a "rear" position. The clockwise direction and the counter clockwise direction are determined on the sheet where the references figure is illustrated.

The acoustic piano 1 is a standard upright piano, and largely comprises a keyboard 1*a*, a plurality of key action mechanisms 1*b*, a plurality of hammer assemblies 1*c*, a plurality of damper assemblies 1*d* and a plurality of sets of strings 1*e*.

The keyboard 1*a* is implemented by an array of black and white keys 1*f*, and eighty-eight black and white keys 1*f* are usually incorporated in the array. The back and white keys 1*f* are turnable with respect to balance pins 1*ga* (see figure), and capstan button 1*fa* upwardly projects from the rear end portion of each of the black and white keys 1*f*. The balance pins 1*ga* upwardly project from a balance rail 1*gb*, and the balance rail 1*gb* is mounted on a key bed 1*gc*. A front rail 1*gd* and a back rail 1*ge* are also mounted on the key bed 1*gc*, and receive the front end portion of the key 1*f* and the rear end portion of the key 1*f*. While no force is exerted on the front end portion of the key 1*f*, the rear end portion is held in contact with the back rail cloth 1*gf* attached to the back rail 1*ge*, and the key 1*f* is in the rest position. On the other hand, when a pianist depresses the key 1*f*, the front end portion of the key 1*f* is brought into contact with a front pin cloth punching 1*gg* on the front rail 1*gd*, and the key 1*f* reaches the end portion.

The plurality of key action mechanisms 1*b* are similar to one another, and one of the key action mechanisms 1*b* is hereinbelow described for the sake of simplicity.

The key action mechanism 1*b* includes a whippen assembly 1*ba* turnably supported through a whippen flange 1*bb* by a center rail 1*h*. The center rail 1*h* is supported by action brackets 1*i* provided on the key bed 1*gc* at intervals. The capstan button 1*fa* is held in contact with the whippen assembly 1*ba*, and transfers force exerted on the key 1*f* to the whippen assembly 1*ba*.

The key action mechanism 1*b* further includes a jack 1*bc* turnably supported by the whippen assembly 1*ba* and a regulating button mechanism 1*bd* for regulating an escape point. A jack spring 1*be* urges the jack 1*bc* in the clockwise direction at all times, and the toe 1*bf* of the jack 1*bc* is opposed to the regulating button mechanism 1*bd*. On the other hand, a jack stop rail felt 1*bg* supported by the center rail 1*h* restricts the rotation of the jack 1*bc* in the counter clockwise direction, and the position of the jack stop rail felt 1*bg* is regulable by rotating a stop rail regulating screw 1*bh*. While the capstan button 1*fa* is upwardly pushing the whippen assembly 1*ba*, the toe 1*bc* is brought into contact with the regulating button mechanism 1*bd*, and the jack 1*bc* quickly turns in the counter clockwise direction around a jack flange 1*bk*. As a result, the hammer assembly 1*c* escapes from the jack 1*bc*, and starts the free rotation toward the associated set of strings 1*e*.

The hammer assembly 1*c* includes a hammer butt 1*ca* engageable through a butt skin 1*cb* with the jack 1*bc*, a hammer shank 1*cc* projecting from the hammer butt 1*ca*, a hammer head 1*cd* attached to the leading end of the hammer shank 1*cc* and a butt spring 1*ce* urging the hammer butt 1*ca* in the counter clockwise direction. The hammer assembly 1*c* is spaced from the set of strings 1*e* in the rest position of the associated key 1*f*, and the position of the hammer assembly 1*c* is hereinbelow referred to as "home position". When the hammer butt 1*ca* escapes from the jack 1*bc*, the pianist suddenly feels the depressed key 1*f* light, and the hammer butt 1*ca* and the jack 1*bc* give the unique piano touch to the pianist at the escape.

The hammer assembly 1*c* further includes a catcher mechanism 1*cf* projecting from the hammer butt 1*ca* and angularly spaced from the hammer shank 1*cc* around 90 degrees, a back check 1*cg* projecting from the whippen assembly 1*ba* and opposed to the catcher mechanism 1*ce*, a bridle wire 1*ch* projecting from the whippen assembly 1*ba* and a bridle tape 1*ci* connected between the catcher mechanism 1*cf* and the bridle wire 1*ci*. The hammer butt 1*ca* is turnably supported by a butt flange 1*ck*, and the butt flange 1*ck* is attached to the center rail 1*h*. These component members 1*cf* to 1*ci* cause the hammer assembly 1*c* to follow the key action mechanism 1*b* after the release of the depressed key 1*f*, and prevent the set of strips from a double strike.

A hammer rail 1*ja* is supported through hammer rail hinges 1*jb* by the action brackets 1*i*, and a plurality of damper units 1*k* are attached to the hammer rail 1*ja*. The plurality of damper units 1*k* are provided for the hammer assemblies 1*c*, respectively, and each of the damper units 1*k* includes a plunger 1*ka* retractable into a holder 1*kb*. Though not shown in the drawings, a damping member such as, for example, a piece of rubber is provided in the holder, and absorbs an impact of the plunger 1*ka*. After the escape from the jack 1*bc*, the hammer assembly 1*c* is rotated toward the set of strings 1*e*, and the hammer shank 1*cc* rebounds on the strings 1*e* or the silent system 4. The hammer assembly 1*c* returns toward the home position, and is brought into contact with the plunger 1*ka*. The plunger retracts into the holder 1*kb*, and absorbs the impact of the hammer assembly 1*c*.

The damper mechanism 1*d* includes a damper spoon 1*da* projecting from the whippen assembly 1*ba*, a damper lever 1*db* turnable with respect to the center rail 1*h*, a damper wire 1*dc* upwardly projecting from the damper lever 1*db*, a damper head 1*de* fixed to the leading end of the damper wire 1*dc* and a damper spring 1*df* urging the damper lever 1*db* in the clockwise direction. When the key 1*f* is staying in the rest position, the damper spring 1*df* causes the damper head 1*de* to be held in contact with the set of strings 1*e*. While the key 1*f* is being depressed, the whippen assembly 1*ba* turns in the clockwise direction, and the damper spoon 1*da* causes the damper lever 1*db* to turn in the counter clockwise direction against the damper spring 1*df*, and the damper head 1*de* is spaced from the set of strings 1*e*. As a result, the set of strings 1*e* is allowed to vibrate upon impact of the hammer assembly 1*c*. After the release of the depressed key 1*f*, the whippen assembly 1*ba* and the damper spoon 1*da* turn in the counter clockwise direction, and the damper spring 1*df* urges the damper lever 1*db* in the clockwise direction. As a result, the damper head 1*de* is brought into contact with the set of strings 1*e*, and stops the strings 1*e* to vibrate.

Although the acoustic piano 1 further comprises damper/muffler/soft pedal mechanisms, only a damper rod 1*m* is illustrated in FIG. 2. The damper rod 1*m* spaces all the damper heads 1*de* from the associated sets of strings 1*e*, and prolongs the vibrations of the strings 1. Thus, the acoustic piano 1 is similar in structure to a standard upright piano, and similarly behaves in the standard playing mode.

The automatic playing system 2 includes a controlling unit 2*a*, a plurality of solenoid-operated actuator units 2*b* respectively associated with the black and white keys 1*f* and a reproduction switch 2*c* on a manipulating panel 6. The controlling unit 2*a* is shared with the electronic sound generating system 3, the silent system 4 and the recording system 5, and will be described hereinlater with reference to FIG. 4.

A plunger 2*ba* and a solenoid wound on a bobbin form in combination each of the solenoid-operated actuator units 2*b*, and the bobbin is accommodated in a solenoid case 2*bb*. The solenoid case 2*bb* is mounted on the key bed 1*gc* beneath the associated key 1*f*, and the plunger 2*ba* upwardly projects from the solenoid case 2*bb* with driving current DR.

In the automatic playing mode, the controlling unit 2*a* sequentially fetches a series of music data codes representative of a performance, and determines the black and white keys 1*f* to be depressed, the damper/muffler/soft pedals to be pressed down and the amount of driving current DR supplied to the solenoid-operated actuators associated with the selected keys and the selected pedals. The controlling unit 2*a* selectively supplies the driving current DR to the solenoid-operated actuator units 2*b*, and the solenoid-operated actuator units 2*b* moves the keys 1*f* and the pedals as if a pianist plays the piano 1. The music data codes may be stored in a floppy disk 7 or directly supplied from another electronic system.

The electronic sound generating system 3 includes the controlling unit 2*a*, a plurality of hammer sensors 3*b* respectively provided for the hammer assemblies 1*c*, a head-phone 3*ca*, a speaker sub-system 3*cb* and a plurality of key sensors 3*d* for monitoring the black and white keys 1*f*, respectively. In this instance, both of the head-phone 3*ca* and the speaker sub-system 3*cb* are incorporated in the electronic sound generating system 3. However, only one of the head-phone 3*ca* and the speaker sub-system 3*cb* may be provided for another keyboard musical instrument according to the present invention.

A shutter plate 3*e* and a photo-interrupter 3*f* as a whole constitute each of the hammer sensors 3*b*. A window 3*g* is formed in the shutter plate 3*e*, and the shutter plate 3*e* is attached to the hammer shank 1*cc*. The photo-interrupters 3*f* are fixed to a rail member 3*h*, and the rail member 3*h* is supported by the action brackets 1*i*. A photo-emitting element (not shown), a photo-receiving element (not shown) and a pair of optical fibers coupled to the photo-emitting/photo-receiving elements form each of the photo-interrupters 3*f*. Slits 3*i* are formed in the rail member 3*h* at intervals, and allow the shutter plates 3*e* to pass therethrough.

The optical fibers of each pair are confronted with each other on both sides of the slit 3*i*, and the shutter plate 3*e* intermittently interrupts the light beam between the optical fibers. Reference sign 3*j* designates cushion members attached to the rear surface of the rail member 3*h*, and the cushion members 3*j* gently receive the damper wires 1*dc* without noise.

While the hammer assembly 1*c* is turning toward the set of strings 1*e*, the leading edge of the shutter plate 3*e* intercepts the light beam, then the window 3*g* allows the light beam to bridge the slit 3*i* through the window 3*g*, and, finally, the boss portion of the shutter plate 3*e* intercepts the light beam again. Thus, the light beam is intercepted twice before striking the strings 1*e* or rebounding on the silent system 4.

The interception of the light beam and the photo-detection through the window 3*g* change a hammer position signal HP. In other words, the hammer motion is detected by the associated hammer sensor 3*b*, and the hammer position signal HP is indicative of the current hammer position on the trajectory of the hammer assembly 1*c*.

The key sensor 3*d* is implemented by a combination of a shutter plate 3*da* and a photo-interrupter array 3*db*. The shutter plate 3*da* is attached to the lower surface of the associated key 1*f*, and is moved together. An upper photo-interrupter and a lower photo-interrupter are incorporated in the array 3*db*, and are spaced along the trajectory of the shutter plate 3*da*.

While a pianist is depressing the key 1*f*, the shutter plate 3*da* firstly intercepts the light beam of the upper photo-interrupter, and, thereafter, the light beam of the lower photo-interrupter. On the contrary, when the pianist releases the depressed key 1*f*, the shutter plate 3*da* firstly provides an optical path for the lower photo-interrupter and, thereafter, for the upper photo-interrupter.

The controlling unit 2*a* acknowledges the depressed key with the hammer position signal HP, and determines a timing for generating an electronic sound on the basis of the second interception. Moreover, the controlling unit 2*a* acknowledges a key-off event, i.e., the release of a depressed key through a key position signal KP supplied from the associated key sensor 3*d*. The key-off event is indicative of a contact timing for damping the vibration of the strings 1*e* with the damper head 1*de*.

The controlling unit 2*a* further estimates the intensity of impact against the strings 1*e* on the basis of lapse of time between the first photo-interception and the second photo-interception. This is because of the fact that the intensity of an impact is proportional to the hammer velocity during the free rotation. The lapse of time is inversely proportional to the hammer velocity, and the intensity of the impact is estimable on the basis of the lapse of time.

The controlling unit 2*a* formats a key-on event data indicative of the depressing of a key, a key-off event data indicative of the release of a key, a pedal-on event data indicative of the step-on of a pedal, a pedal-off event data indicative of the release of a pedal, a key code data indicative of the depressed key, a hammer velocity data indicative of the intensity of an impact against a set of string and a duration data indicative of a lapse of time in the reproduction in accordance with the MIDI (Musical Instrument Digital Interface) standards, and, accordingly, generates a series of music data codes representing a performance. The controlling unit 2*a* generates electronic sounds from the music data codes in a real time fashion, and/or supplies the music data codes to another electronic sound system.

If a pianist selects the real time sound generation, the controlling unit 2*a* starts to generate an electronic sound with the note assigned to the depressed key 1*f* at the impact timing, and regulates the loudness of the electronic sound to the estimated intensity. The electronic sound is terminated at the contact timing. If the timbre of piano tones is selected by a pianist, the electronic sounds generated through the headphone 3*ca* and/or the speaker sub-system 3*cb* allows the pianist to confirm the fingering on the keyboard 1*a*.

The silent system 4 includes a hammer stopper 4*a* changeable between a free position FP and a blocking position BP, a silent switch 4*b* on a manipulating board 6, a bi-directionally rotatable motor unit 4*c* coupled to the hammer stopper 4*a* and the controller 2*a* responsive to an instruction signal INST supplied from the silent switch 4*b* for driving the motor unit 4*c*. A rotatable shaft 4*d*, bracket members 4*e* attached to the rotatable shaft 4*d* at intervals and cushion members 4*f* fixed to the bracket members 4*e* form in combination the hammer stopper 4*a*, and the hammer stopper 4*a* is provided over the catcher mechanism 1*cf*. The rotatable shaft 4*d* is journaled on bearing units (not shown) supported by the action brackets 1*i*, and the motor unit 4*c* bi-directionally rotates the shaft 4*d* over 90 degrees. The cushion member 4*f* is implemented by a felt sheet overlain by a protective pad of, for example, artificial leather.

When the hammer stopper 4*a* is in the free position FP, the hammer assemblies 1*c* strike the associated sets of strings 1*e* without an interception of the hammer stopper 4*a*, and the strings 4*e* vibrate for generating acoustic sounds. On the other hand, if the hammer stopper 4*a* is changed to the blocking position BP, the catcher mechanism 1*cf* rebounds on the cushion member 4*f* after the escape, and the hammer assembly 1*c* returns to the home position on the way toward the associated set of strings 1*e*.

The recording system 5 includes a recording switch 5*a* on the manipulating panel 6, the controlling unit 2*a*, the plurality of hammer sensors 3*b* and the plurality of key sensors 3*d*. The controlling unit 2*a* stores the music data codes indicative of the original performance in the floppy disk 7.

Figure 4:
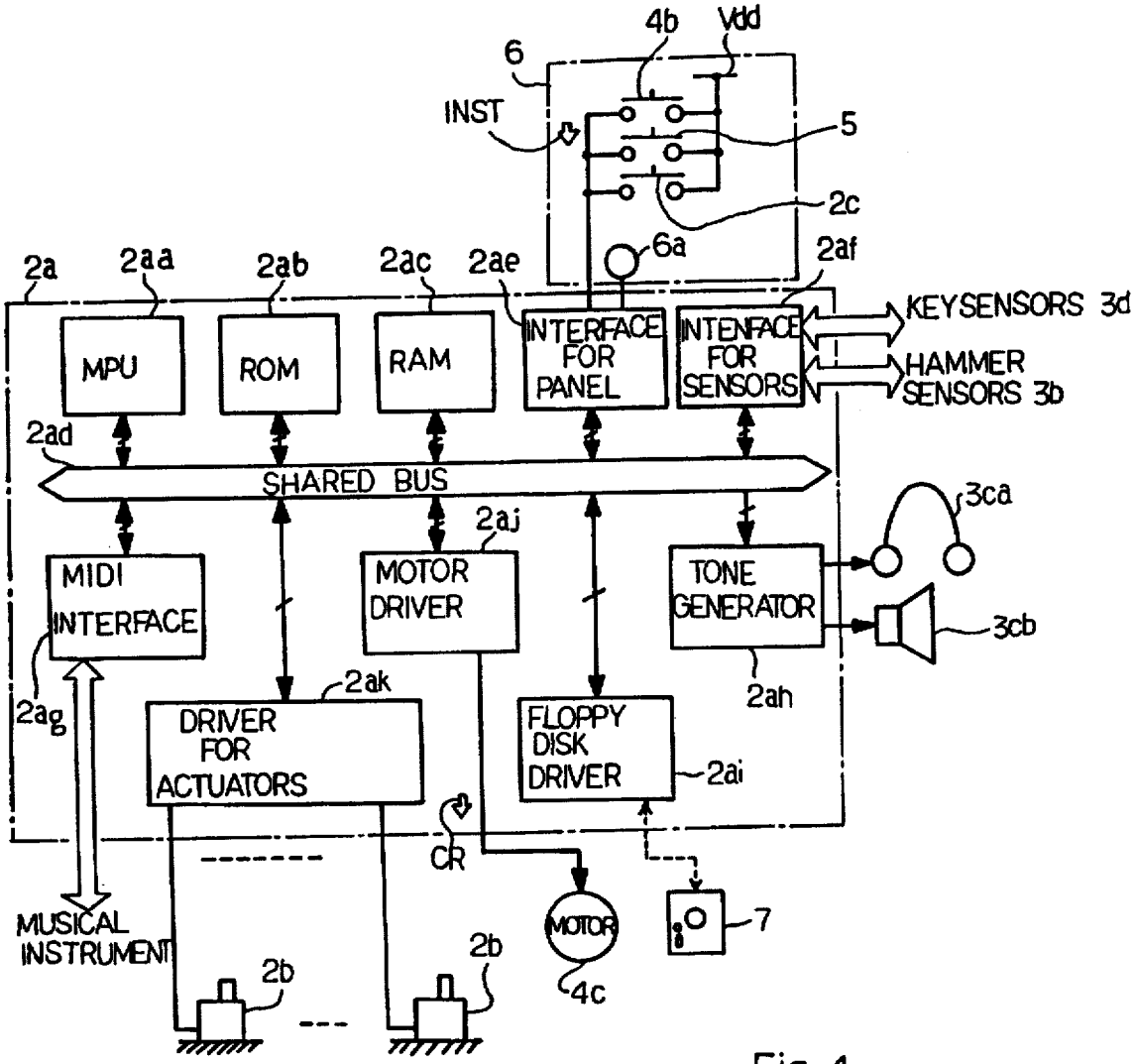
FIG. 4 is a block diagram showing the circuit arrangement of a controlling unit incorporated in the keyboard musical instrument.

Turning to FIG. 4 of the drawings, the controlling unit 2*a* includes a microprocessor 2*aa*, a program memory 2*ab* and a working memory 2*ac*. The microprocessor 2*aa* is abbreviated as "MPU", and the program memory 2*ab* and the working memory 2*ac* are implemented by a read only memory device (abbreviated as "ROM") and a random access memory device (abbreviated as "RAM"). The program memory 2*ab* stores not only instruction codes forming a program sequence but also tables defining the relation between the hammer velocity data and a key velocity. In the automatic playing mode, the solenoid-operated actuator unit 2*b* is expected to move the associated key 1*f* at the key velocity. On the other hand, the working memory 2*ac* provides a temporary data storage to the microprocessor 2*aa*. The music data codes expressing a performance and control data codes are, by way of example, memorized in the temporary data storage. The microprocessor 2*aa* sequentially fetches the instruction codes through a shared bus 2*ad*, and executes the program sequence for the automatic playing mode, the silent mode and the recording mode as will be described hereinlater.

The controlling unit 2*a* further includes interfaces 2*ae*, 2*af* and 2*ag* coupled to the shared bus 2*ad*, and the microprocessor 2*aa* periodically scans these interfaces 2*ae* to 2*ag*.

The interface 2*ae* is assigned to the manipulating panel 6, and transfers instructions supplied through the switches 2*c*, 4*b*, 5*a*, 6*a* and so fourth to the microprocessor 2*aa*. When a listener wants to change the loudness of the electronic sounds, he manipulates the switch 6*a*. Other switches are assigned to the timbre of the electronic sounds.

The interface 2af is assigned to the hammer sensors 3b and the key sensors 3d, and transfers digital hammer position signals DHP and digital key position signals DKP to the microprocessor 2aa.

The interface 2ag is called as "MIDI Interface", and the music data codes are transferred through the MIDI interface 2ag to and from an external musical instrument.

The controlling unit 2a further includes a tone generator 2ah which produces an analog audio signal from the music data codes. The tone generator 2ah stores not only a tone waveform for the timbre of the acoustic piano sounds but also tone waveforms for the other timbres, and the microprocessor 2aa instructs the tone generator 2ah to tailor the analog audio signal in one of the waveforms in response to the switch on the manipulating panel 6. The analog audio signal is supplied to the head-phone 3ca and the speaker sub-system 3ca, and the pianist hears the electronic sounds through them in the silent mode.

The controlling unit 2a further includes a floppy disk driver 2ai, a motor driver 2aj and an actuator driver 2ak. These drivers 2ai to 2ak are a kind of interface.

The floppy disk 7 is is inserted into the floppy disk driver 2ai, and the floppy disk driver 2ai writes the music data codes into and reads out them from the floppy disk 7. Namely, the microprocessor 2aa responds to the instruction signal INST indicative of the recording mode, and transfers the music data codes to the floppy disk driver 2ai. The floppy disk driver 2ai sequentially writes the music data codes into the floppy disk 7. On the other hand, when the automatic playing mode is selected by manipulating the switch 2c, the microprocessor 2aa instructs the floppy disk driver 2ai to transfer the music data codes to the working memory 2ac, and the microprocessor 2aa determines the actuated key 1f and the amount of driving current on the basis of the music data codes.

The motor driver 2aj is connected to the motor unit 4c, and supplies electric current CR thereto. Namely, when the switch 4b is depressed, the microprocessor 2aa instructs the motor driver 2aj to rotate the motor unit 4c in one direction so as to change the hammer stopper 4a from the free position FP to the blocking position. The microprocessor 2aa raises a silent flag in the working memory 2ac, and the instruction for the silent mode is maintained in the working memory 2ac.

If the pianist depresses the switch 4b again, the microprocessor 2aa instructs the motor driver 2aj to rotate the motor unit 4c in the other direction so as to change the hammer stopper 4a from the blocking position BP to the free position FP. The microprocessor 2aa retracts the silent flag, and cancels the instruction for the silent mode.

The actuator driver 2ak is connected to the solenoid-operated actuators 2b, and selectively supplies the driving current under the control of the microprocessor 2aa.

Subsequently, description is made on the modes of operation.

First, assuming now that a pianist starts a fingering on the keyboard la without manipulation on the switches 4b, 5a and 2c. The hammer stopper 4a remains in the free position FP, and the black and white keys 1f are selectively depressed during the fingering on the keyboard 1a. When one of the keys 1f is depressed, the capstan button 1fa pushes up the whippen assembly 1ba, and the associated key action mechanism 1b and the associated damper mechanism 1d are actuated.

In detail, the whippen assembly 1ba turns around the whippen flange 1bb in the clockwise direction, and the damper spoon 1da declines toward the rear side. As a result, the damper lever 1db turns in the counter clockwise direction, and the damper head 1de is spaced from the set of strings 1e.

On the other hand, the jack 1bc turns around the whippen flange 1bb together with the whippen assembly 1ba, and causes the hammer assembly 1c to turn around the butt flange in the clockwise direction. When the toe 1bf is brought into contact with the regulating mechanism 1bd, the jack 1bc quickly turns around the jack flange 1bk in the counter clockwise direction, and kicks the hammer butt 1ca. The hammer assembly 1c starts the free rotation toward the set of strings 1e, and strikes the set of strings 1e. The strings 1e vibrate, and generates the acoustic tone with the note assigned to the depressed key 1f.

The hammer head 1cd rebounds on the set of strings 1e, and the hammer assembly 1c turns around the butt flange 1ck in the counter clockwise direction. The catcher mechanism 1cf is brought into contact with the back check 1cg, and the hammer head 1cd is now allowed to strike the stings 1e again.

When the pianist releases the depressed key 1f, the capstan button 1fa is downwardly moved, and allows the whippen assembly 1ba to turn in the counter clockwise direction. The damper spoon 1da returns from the declines position, and the damper spring 1df urges the damper lever 1db to turn in the clockwise direction. As a result, the damper head 1de is brought into contact with the set of strings 1e, and absorbs the vibrations of the strings 1e.

The rotation of the whippen assembly 1ba in the counter clockwise direction allows the jack 1bc to slide into the position beneath the butt skin 1cb.

Thus, the black and white keys 1f cooperate with the key action mechanisms 1b, the hammer assemblies 1c and the damper mechanisms 1d, and generates the acoustic sounds in the standard playing mode.

Subsequently, if the pianist depresses the switch 4b, the microprocessor 2aa fetches the instruction signal INST indicative of the silent mode through the interface 2ae, and instructs the motor driver 2aj to rotate the motor unit 4c so as to change the hammer stopper 4a to the blocking position BP. The cushion members 4f are opposed to the catcher mechanisms 1cf in the blocking position BP. The pianist is assumed to select the timbre of the piano tones.

While the pianist is fingering on the key board 1a, the key action mechanisms 1b cooperates with the damper mechanisms 1d and the hammer assemblies 1c cooperate as similar to those in the standard playing mode. Although the hammer butt 1ca escapes from the jack 1bc upon the contact between the toe 1bf and the regulating button mechanism 1bd, the catcher mechanism 1cf rebounds on the cushion member 4f during the free rotation of the hammer assembly 1c, and the hammer head 1cd does not strike the set of strings 1e. Thus, the hammer assembly 1c gives the unique piano touch to the pianist in cooperation with the jack 1bc, but does not strike the set of strings 1e.

While the hammer assembly 1c freely turning toward the set of strings 1e, the leading edge of the shutter plate 3e intercepts the light beam of the hammer sensor 3f, and, thereafter, the boss portion of the shutter plate 3e intercepts the light beam of the hammer sensor 3f again.

When the light beam is firstly intercepted by the leading edge, the hammer position signal HP changes the potential level, and the microprocessor 2aa fetches the digital hammer position signal through the interface 2af. The microprocessor 2aa determines the key code assigned to the depressed key 1f.

When the light beam is intercepted by the boss portion of the key 1*f*, the hammer position signal HP changes the potential level again, and the microprocessor 2*aa* acknowledges the second interception. The microprocessor 2*aa* determines a timing for the tone generation at the second interception, and produces the key-on data. The microprocessor 2*aa* calculates the hammer velocity on the basis of the lapse of time between the first interception and the second interception. The key-on data, the key code and the hammer velocity data are formatted into the music data codes.

The music data code is supplied from the microprocessor 2*aa* to the tone generator 2*ah*, and the tone generator 2*ah* starts to tailor the audio signal at the timing for the tone generation. The audio signal is, by way of example, supplied to the head-phone 3*ca*, and generates the electronic sound like the piano tone. The loudness of the electronic sound is adjusted to the level instructed through the switch 6*a*.

When the pianist releases the depressed key 1*f*, the shutter plate 3*da* sequentially provides the optical path to the lower photo-interrupter and, thereafter, to the upper photo-interrupter. The key position signal KP changes the potential level, and the microprocessor 2*aa* fetches the digital key position signal through the interface 2*af*. When the shutter plate 3*da* provides the optical path to the upper photo-interrupter, the damper head 1*de* is brought into contact with the set of strings 1*e* again, and the second optical path is indicative of the timing for the tone termination. Then, the microprocessor 2*aa* produces the key-off data for the released key 1*f*, and the key-off data is introduced into the music data code together with the key code. The microprocessor 2*aa* supplies the music data code to the tone generator 2*ah*, and the tone generator 2*ah* causes the head-phone to extinguish the electronic sound at the timing for the tone termination.

When the pianist selectively presses the damper/muffler/soft pedals, the associated pedal sensors (not shown) report the pedal motion through the interface 2*af* to the microprocessor 2*aa*, and the microprocessor 2*aa* produces the music data codes for the depressed pedal.

In this way, the tone generator 2*ah* tailors the audio signal on the basis of the music data codes, and the head-phone 3*ca* generates the electronic sounds from the audio signal instead of the acoustic piano sounds.

In the standard playing mode and the silent mode, it is possible to transfer the music data codes through the MIDI interface 2*ag* to another musical instrument.

If the pianist pushes the switch 5*a* in the standard playing mode or the silent mode, the microprocessor 2*aa* supplies the music data codes to the floppy disk driver 2*ai*, and the music data codes are stored in the floppy disk 7.

Subsequently, description is made on the behavior in the automatic playing mode. When the player pushes the switch 2*c*, the microprocessor 2*aa* instructs the floppy disk driver 2*ai* to transfer the music data codes to the working memory 2*ac* in both modes. A difference between the acoustic sound sub-mode and the electronic sound sub-mode is the position of the hammer stopper 4*a*. Namely, the hammer stopper 4*a* stays in the free position FP in the acoustic sound sub-mode and in the blocking position BP in the electronic sound sub-mode.

The microprocessor 2*aa* sequentially fetches the music data codes through a timer interruption. The timer interruption is carried out in synchronism with a tempo-clock, and the timer interruption takes place twenty four times for each crotchet.

The music data codes contains the event-data such as the key-on data, the key-off date, the pedal-on data, the pedal-off data, the key code and the key velocity data and the duration data as described hereinbefore. The duration data read out from the working memory is decremented by the tempo-clock, and the microprocessor 2*aa* fetches the next music data codes when the duration data reaches zero. Thus, the event data are arranged with time, and are sequentially processed with reference to the duration data. In other words, the music data codes are read out from the working memory 2*ac* at relative timings substantially identical with the relative timings for the tone generations.

Figure 5:
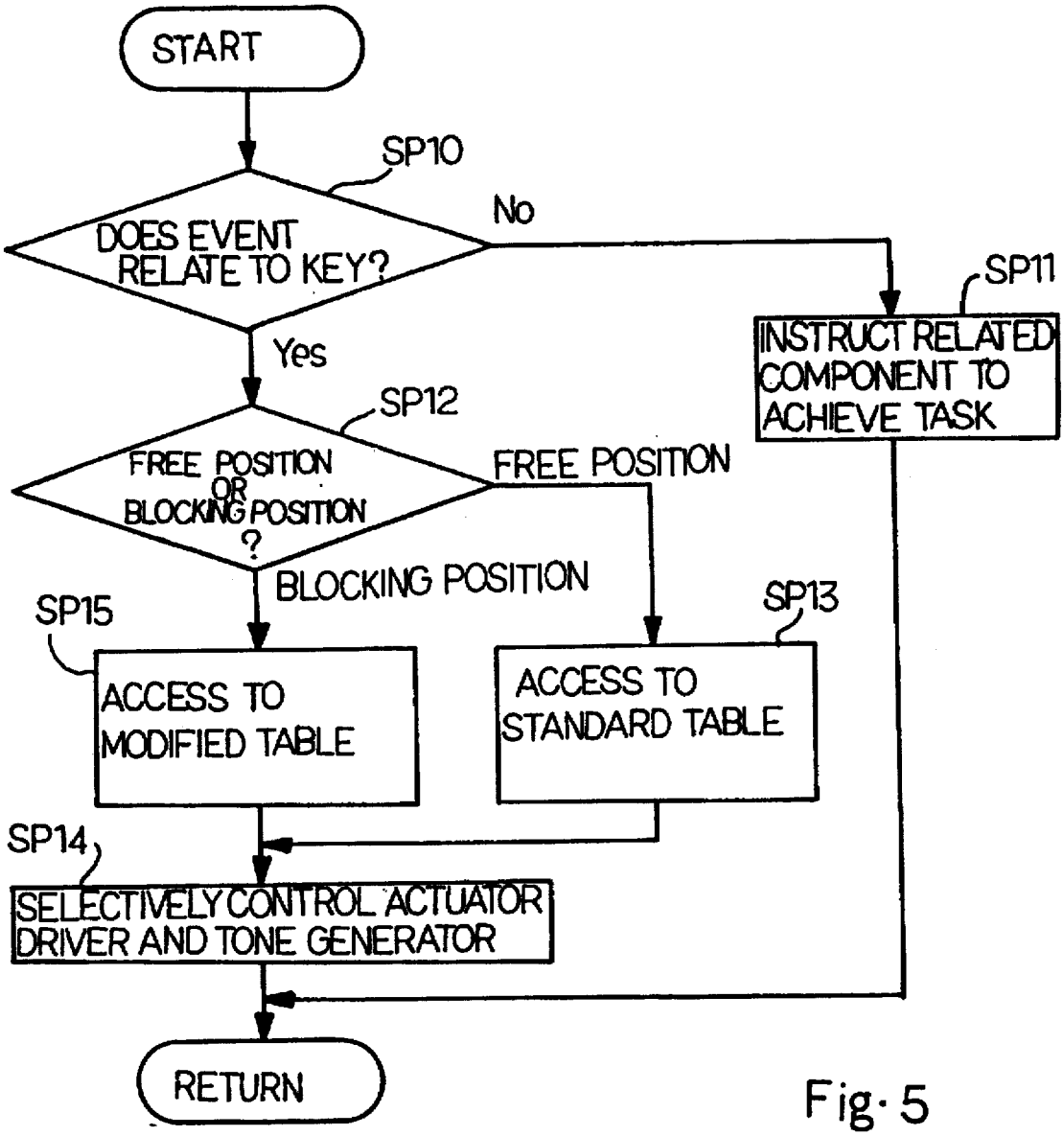
FIG. 5 is a flow chart showing a program sequence executed by a microprocessor incorporated in the controlling unit.

FIG. 5 illustrates a program sequence executed by the microprocessor 2*aa* upon read-out of each event data. The microprocessor 2*aa* firstly checks the music data code to see whether or not the event relates to one of the keys 1*f* as by step SP10.

If the answer at step SP10 is given negative, the microprocessor 2*aa* proceeds to step SP11, and the microprocessor 2*aa* instructs a related component such as, for example, a pedal actuator to achieve the task defined by the music data code.

On the other hand, if the answer at step SP10 is given affirmative, the microprocessor 2*aa* proceeds to step SP12, and checks the silent flag to see whether the hammer stopper 4*a* is in the free position FP or the blocking position BP.

Figure 6A:
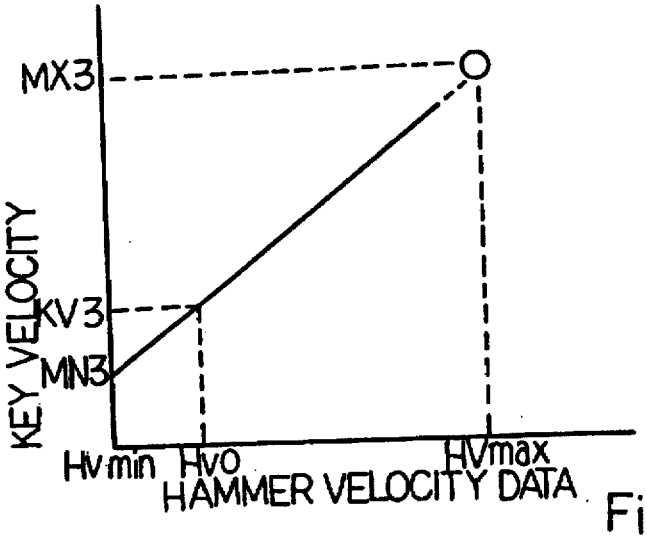
FIGS. 6A to 6C are graphs showing the relation between a hammer velocity and a key velocity at different volumes selectively accessed in an acoustic sound sub-mode.
Figure 6B:
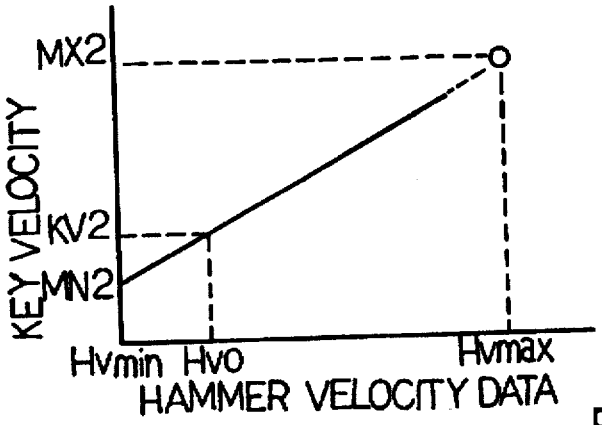
Figure 6C:
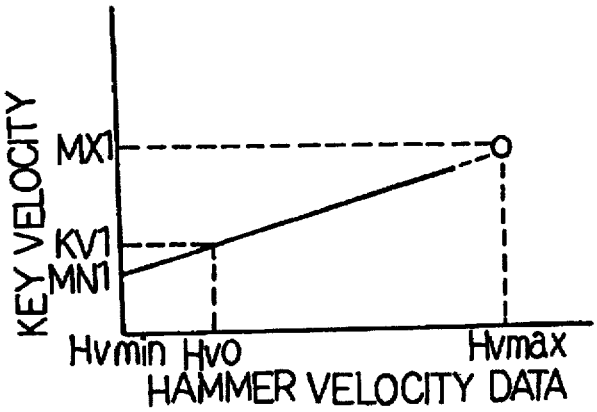

As described hereinbefore, the program memory 2*ab* stores a plurality of tables defining the relation between the hammer velocity data and the key velocity of a key 1*f* to be depressed, and FIGS. 6A to 6C illustrates the relation stored in standard tables. The three standard tables shown in FIGS. 6A to 6C are accessed under a large volume, an intermediate volume and a small volume, respectively, and the key velocity at the hammer velocity data Hv0 is increased from Kv1 through Kv2 to Kv3 together with the volume. Although the values of the key velocity at the minimum hammer velocity data are close to one another, when the volume is enlarged, the difference is increased. In other words, when a pianist increases the volume, the increment of the key velocity is also increased. Selectively accessing to the standard tables, the keyboard musical instrument reproduces the acoustic sounds at different loudness.

Turning back to the flow chart, if the silent flag is retracted, the microprocessor 2*aa* braches the control to step SP13, and accesses one of the standard tables depending upon the volume instructed through the volume switch 6*a*. The microprocessor 2*aa* converts the hammer velocity data to the key velocity, and proceeds to step SP14. The microprocessor 2*aa* supplies the key code data, the key-on/key-of data, which are extracted from the music data code, and the key velocity to the actuator driver 2*ak*. Accordingly, the actuator driver 2*ak* starts to supply the driving current DR corresponding to the key velocity to the solenoid-operated actuator unit 2*b* designated by the key code or decreases the driving current to zero. As a result, the solenoid-operated actuator unit 2*b* projects or retracts the plunger, and moves the associated key 1*f*.

The electro-magnetic force is proportional to the amount of driving current DR, and the associated key 1*f* is moved at a speed corresponding to the amount of driving current DR. The motion of the key 1*f* is transferred to the key action mechanism 1*b*, and the key action mechanism 1*b* actuates the hammer assembly 1*c* and the damper mechanism 1*d*. The damper head 1*de* is spaced from the set of strings 1*e*, and the key action mechanism 1*b* rotates the hammer assembly 1*c* toward the set of strings 1*e*. The hammer velocity is proportional to that of the original performance depending upon the loudness instructed through the volume switch 6*a*, and strikes the set of strings 1*e* at the corresponding intensity. The set of strings 1*e* vibrate, and generates the acoustic. If the volume switch 6*a* is adjusted to the original loudness, the acoustic sound is approximately equal in loudness to the sound in the original performance.

On the other hand, if the switches 2*c* and 4*b* have been manipulated, the answer at step SP12 is "blocking position BP", and the microprocessor 2*aa* proceeds to step SP15. A modified table is used for converting the hammer velocity data to the key velocity instead of the standard tables. The instruction for the loudness is invilid, and the microprocessor 2*aa* accesses the modified table regardless of the position of the volume switch 6*a*.

Figure 7:
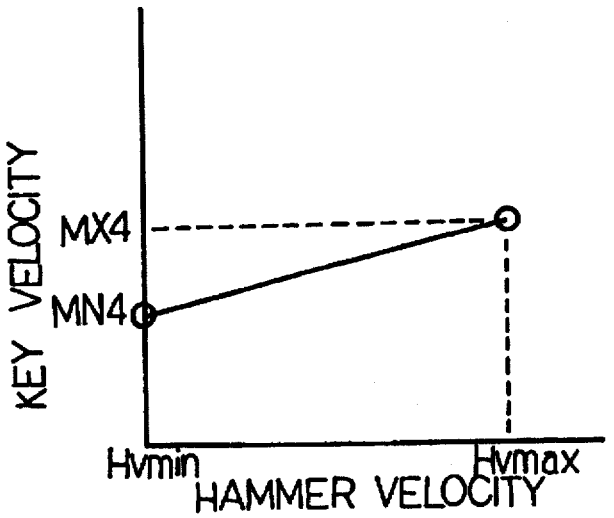
FIG. 7 is a graph showing the relation between the hammer velocity and the key velocity in an electronic sound sub-mode.

FIG. 7 illustrates the relation between the hammer velocity and the key velocity in the modified table. The key velocity MN4 at the minimum hammer velocity Hvmin is larger than those MN1 to MN3 defined in the standard tables, and the increment of the key velocity is slightly larger than the increment defined in the standard table at the small volume shown in FIG. 6C. On the other hand, the key velocity MX4 at the maximum hammer velocity Hvmax is smaller than that MX2 of the standard table shown in FIG. 6B. For this reason, while the keyboard musical instrument is reproducing the sounds in the electronic-sound sub-mode, the loudness at a small hammer velocity is larger than the loudness in the acoustic sound sub-mode, and a large hammer velocity results in a loudness between the small volume shown in FIG. 6C and the middle volume shown in FIG. 6B.

The minimum key velocity MN4 is regulated to a certain value allowing the key action mechanism 1*b* and the hammer assembly 1*c* to respond to a quick fingering on the same key 1*f*, and the keyboard musical instrument can reproduce a repetition such as the trill. On the other hand, the maximum key velocity MX4 is regulated in such a manner as to give little offense to the ear.

Figure 8A:
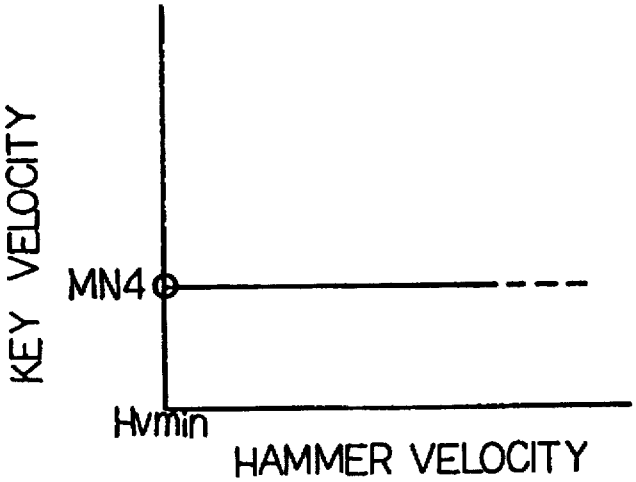
FIGS. 8A and 8B are graphs showing the relation between the hammer velocity and the key velocity defined in other modified tables.

The modified table may define the relation as shown in FIG. 8A. The key velocity is constant at the minimum value MN4. The minimum value MN4 is large enough to reproduce the repetition, and gives little offense to the ear. Although the key motion may not be matched with the electronic sounds, the load on the solenoid-operated actuator units 2*b* is decreased, and the undesirable heat generation is minimized.

Figure 8B:
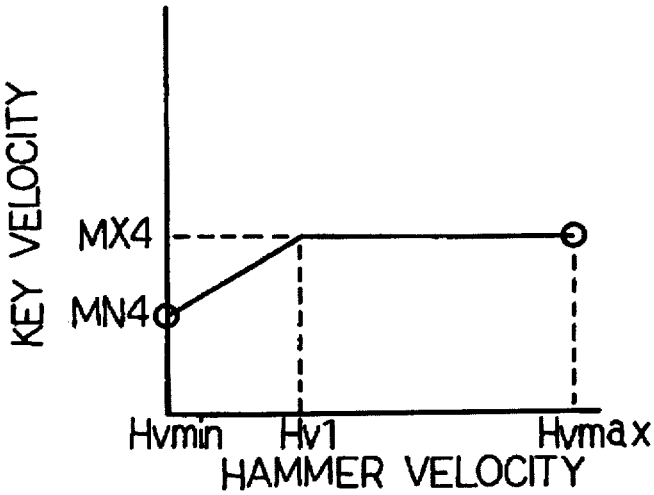

FIG. 8B illustrates yet another relation defined in the modified table. The minimum key velocity MN4 and the maximum key velocity MX4 are equal to those of the modified table shown in FIG. 7. The key velocity is increased together with the hammer velocity until a hammer velocity Hv1, and is constant at the maximum value MX4 after the hammer velocity Hv1. The hammer velocity between the minimum value Hvmin and the upper limit Hv1 is frequently detected in an original performance. In other words, the hammer velocity over the upper limit Hv1 is rare in the original performance. The modified table increases the increment of the key velocity in the frequently detectable hammer velocity range, and the keys 1*f* are moved like in the original performance. The key motions are clearly different between a soft electronic sound and a loud electronic sound, and the modified table shown in FIG. 8B is more desirable than the modified table shown in FIG. 7 in view of the faithful key motion.

Thus, the modified table restricts the key velocity, and eliminates the noise from a playback without malfunction.

Turning back to the flow chart, the microprocessor 2*aa* converts the hammer velocity data to the key velocity by using the modified table, and proceeds to step SP14. The microprocessor 2*aa* supplies the key code data, the key-on/key-off data and the key velocity data to the actuator driver 2*ak*, and the actuator driver 2*ak* determines the amount of driving current DR. The solenoid-operated actuator unit 2*b* moves the associated key 1*f* as similar to the acoustic sound sub-mode. Although the hammer butt 1*ca* escapes from the jack 1*bc*, the catcher mechanism 1*cf* rebounds on the hammer stopper 4*a*, and the hammer head 1*cd* does not reach the set of strings 1*e*. For this reason, an acoustic sound is not generated as similar to the silent mode.

The microprocessor 2*aa* further converts the hammer velocity data to the key velocity without an access to the standard table, and formats the key code data, the key-on/key-off and the key velocity into the MIDI codes. The MIDI codes are transferred to the tone generator 2*ah*, and the tone generator 2*ah* tailors the audio signal on the basis of the MIDI codes. The head-phone 3*ca* and the speaker subsystem 3*cb* generates the electronic sound instead of the acoustic sound. The tone generator 2*ah* is responsive to the instruction given through the volume switch 6*a*, and the loudness of the electronic sounds is changeable by manipulating the volume switch 6*a*.

In this instance, the driving currents DR serves as instructions. The selecting sub-means is implemented by step SP12 executed by the microprocessor 2*aa*, and steps SP13 to SP15 executed by the microprocessor 2*aa* as a whole constitute a converting sub-means.

As will be understood from the foregoing description, the keyboard musical instrument according to the present invention moves the keys 1*f* at a key velocity different between the acoustic sound sub-mode and the electronic sound sub-mode, and the key motion does not give little offensive to the ear. Even though the key velocity is decreased, the timing for the key motion is synchronized with the tone generation, and the listeners do not feel the playback strange.

Moreover, the driving current DR in the electronic sound sub-mode is decreased rather than that in the acoustic sound sub-mode, and only a small amount of heat is generated by the solenoid-operated actuator units 2*b*. As a result, the components of the acoustic piano and other component members are less affected by the heat generation.

The minimum key velocity MN4 is not small that the hammer assemblies 1*c* can be engaged with the jacks 1*bc*, and the keyboard musical instrument according to the present invention faithfully reproduce the quick fingering in the original performance.

Finally, the tone generator 2*ah* tailors the audio signal from the MIDI codes, and the volume of the electronic sounds is controllable by changing the volume switch 6*a*.

Although particular embodiments of the present invention have been shown and described, it will be obvious to those skilled in the art that various changes and modifications may be made without departing from the spirit and scope of the present invention.

For example, the key velocity and the hammer velocity may be converted through a calculation on the basis of equations and/or constants stored in the read only memory device 2*ab*.

Although the above described embodiment memorizes only three standard tables in the read only memory device 2*ab*, more than three standard tables may be stored so as to precisely control the loudness of the acoustic sounds. Another keyboard musical instrument may store a standard table defining the relation among the hammer velocity, the key velocity and the loudness instructed through the volume switch 6*a*.

An economical keyboard musical instrument may not change the volume of the acoustic sounds. If so, the present invention appertains to the economical keyboard musical instrument by restricting the key velocity.

The minimum hammer velocity MN4 may be equal to one of the minimum hammer velocities MN1 to MN3. In this instance, one of the standard tables may serve as the modified table. If a keyboard musical instrument has the three standard tables shown in FIGS. 6A to 6C, the standard table for the small volume is appropriate to the modified table.

The present invention is applicable to the pedal action, i.e., the damper/muffler/soft pedals.

Another economical keyboard musical instrument may be only equipped with the key sensors so as to estimate the hammer velocity.

Although the microprocessor supplies the music data codes and the MIDI codes to the tone generator in the electronic sound sub-mode, the music data codes read out from the floppy disk and the MIDI codes may be supplied to the tone generator in the standard playing mode.

The silent system 4 may intercept any portion of the hammer assemblies 1*c* such as, for example, the hammer shanks 1*cc*, and the hammer stopper may be mechanically changed by manipulating a handle connected through a wire to the hammer stopper.

Finally, the upright piano 1 is replaceable with another acoustic keyboard musical instrument such as, for example, a grand piano, a harpsichord, a celesta and an organ.

What is claimed is:

1. A keyboard musical instrument comprising:

an acoustic keyboard musical instrument including a keyboard having a plurality of keys respectively assigned notes of a scale and selectively moved by a player, a plurality of vibrative string means for generating acoustic sounds having said notes, respectively, a plurality of hammer assemblies each driven for a free rotation so as to strike one of said plurality of vibrative string means, and a plurality of key action mechanisms respectively connected between said plurality of keys and said plurality of hammer assemblies so as to respectively rotate said plurality of hammer assemblies, each of said plurality of key action mechanisms causing one of said plurality of hammer assemblies to escape therefrom before an initiation of said free rotation;

a hammer stopper provided for said plurality of hammer assemblies, and changed between a free position and a blocking position, said hammer stopper in said free position allowing said plurality of hammer assemblies to strike said plurality of vibrative string means, said hammer stopper in said blocking position causing each of said plurality of hammer assemblies to rebound thereon between said initiation of said free rotation and a strike against one of said plurality of vibrative string means;

a plurality of actuators respectively provided for said plurality of keys, and respectively responsive to instructions for moving said plurality of keys instead of said player at respective key velocities, each of said key velocities being varied by changing a magnitude of one of said instructions;

a source of music data codes each containing a piece of impact data information indicative of the loudness of one of said acoustic sounds; and an instruction generating means supplied with said music data codes from said source for regulating the magnitudes of said instructions, said magnitudes of said instructions being changed in a first range when said hammer stopper is in said free position, said magnitude of said instructions being changed in a second range different from said first range so as to restrict said key velocity when said hammer stopper is in said blocking position.

2. The keyboard musical instrument as set forth in claim 1, in which said acoustic keyboard musical instrument is a piano.

3. The keyboard musical instrument as set forth in claim 2, in which said piano is an upright piano.

4. The keyboard musical instrument as set forth in claim 1, in which said piece of impact data information is representative of a hammer velocity expected to one of said plurality of hammer assemblies, said instruction generating means including a standard table defining a relation between said hammer velocity and said key velocity in said first range, a modified table defining a relation between said hammer velocity and said key velocity in said second range, a selecting sub-means for selecting said standard table when said hammer stopper stays in said free position, said selecting sub-means selecting said modified table when said hammer stopper stays in said blocking position, and a converting sub-means responsive to a selection of said selecting sub-means for accessing to said standard table or said modified table, and converting said hammer velocity to said instruction indicative of said key velocity.

5. The keyboard musical instrument as set forth in claim 4, in which said standard table has a plurality of standard sub-tables defining said relation between said hammer velocity and said key velocity at different loudnesses, one of said different loudnesses being selected by a person for said acoustic sounds.

6. The keyboard musical instrument as set forth in claim 5, in which said key velocity at the minimum hammer velocity defined in said modified table is larger than the key velocity at said minimum hammer velocity defined in one of said plurality of standard sub-tables assigned the smallest loudness, and said key velocity at the maximum hammer velocity defined in said modified table is smaller than the key velocity at said maximum hammer velocity defined in another of said plurality of standard sub-tables assigned an intermediate loudness.

7. The keyboard musical instrument as set forth in claim 6, in which said key velocity at said minimum hammer velocity defined in said modified table allows one of said plurality of key action mechanisms and one of said plurality of hammer assemblies to respond to a quick fingering on said keyboard, and said key velocity at said maximum hammer velocity defined in said modified table being restricted in such a manner as not to give little offense to ears of a person.

8. The keyboard musical instrument as set forth in claim 4, in which said modified table defines said key velocity to be constant regardless of said hammer velocity.

9. The keyboard musical instrument as set forth in claim 4, in which said modified table defines said key velocity to be increased together with said hammer velocity until an intermediate hammer velocity, said modified table further defines said key velocity to be constant between said intermediate hammer velocity and the maximum hammer velocity.

* * * * *